US007705223B2

(12) United States Patent
Kirkland et al.

(10) Patent No.: US 7,705,223 B2
(45) Date of Patent: Apr. 27, 2010

(54) ERGONOMIC GUITAR

(75) Inventors: William Eric Kirkland, Petaluma, CA (US); Richard M. Lasner, San Rafael, CA (US); Robert Douglas McDonald, Petaluma, CA (US)

(73) Assignee: Korg USA Inc., Melville, NY (US)

( * ) Notice: Subject to any disclaimer, the term of this patent is extended or adjusted under 35 U.S.C. 154(b) by 0 days.

(21) Appl. No.: 12/218,051

(22) Filed: Jul. 9, 2008

(65) Prior Publication Data

US 2010/0005942 A1 Jan. 14, 2010

(51) Int. Cl.
*G10D 1/08* (2006.01)

(52) U.S. Cl. ..... 84/267; 84/291

(58) Field of Classification Search ..... 84/267, 84/290, 291; D17/14, 19
See application file for complete search history.

(56) References Cited

U.S. PATENT DOCUMENTS

| | | | | |
|---|---|---|---|---|
| D31,129 | S * | 7/1899 | Wirt | D17/19 |
| 3,015,247 | A | 1/1962 | Allers | |
| 3,181,410 | A | 5/1965 | Phillips | |
| 3,396,621 | A | 8/1968 | Dycus | |
| D223,290 | S * | 4/1972 | Wolfe | D17/14 |
| D240,764 | S | 7/1976 | Rendell | |
| D242,648 | S | 12/1976 | Fields | |
| 4,189,974 | A | 2/1980 | Martin et al. | |
| D259,199 | S | 5/1981 | Kelly et al. | |
| D270,842 | S | 10/1983 | Peavey | |
| D274,733 | S | 7/1984 | Hampton et al. | |
| D383,481 | S | 9/1997 | Langdell | |
| D390,250 | S | 2/1998 | McGuire | |
| 5,847,298 | A | 12/1998 | Adams | |
| D407,430 | S | 3/1999 | Rosenberg et al. | |
| 6,849,792 | B2 | 2/2005 | Yeakel | |
| D513,277 | S | 12/2005 | Thornton | |
| D517,114 | S | 3/2006 | Knaggs et al. | |
| D531,202 | S | 10/2006 | Cook | |
| D531,203 | S | 10/2006 | Cook | |
| D553,180 | S | 10/2007 | Cook | |
| D561,817 | S | 2/2008 | D'Ambrosio | |
| 2007/0000370 | A1 * | 1/2007 | Blake | 84/290 |

* cited by examiner

*Primary Examiner*—Jianchun Qin
(74) *Attorney, Agent, or Firm*—Drinker Biddle & Reath LLP

(57) ABSTRACT

An ergonomic guitar including a contoured guitar body, a neck attached to the body, and a headstock on the distal end of the neck. A plurality of strings extending from the headstock to the body, a portion of the strings lying on a playing plane over the body. The contoured guitar body includes a front face located on a front or playing side of the body with a front edge extending around the periphery of the front face, and a rear face located on the back of the body and having a rear edge extending around the periphery of the rear face. At least a portion of the rear edge having a concave curvature relative to the playing plane such that the curved portion of the rear edge curves away from the playing plane.

20 Claims, 9 Drawing Sheets

ERGONOMIC GUITAR

FIELD OF THE INVENTION

The present invention relates to guitars and, more particularly to a guitar with a guitar with an ergonomic curvature in the guitar body for ease in playability.

BACKGROUND

Guitars have not drastically changed in their basic features since they were first developed. A guitar still includes a body, neck, and headstock. There has, however, been significant changes and improvements made to the component parts of the guitar, including the materials from which the guitar is made, improved pick-up design, and sound controls (for electric guitars), improvements in bracing (for acoustic guitars), and how the guitars are assembled. There have also been many changes to the ornamental appearance of the guitar.

While some of changes that have been made were dictated by attempts to simplify the assembly of the guitar for mass production, most of the changes have been designed to improve or vary the sound emitted by the guitar. The ornamental changes that have been made to guitars have, for the most part, been incorporated to create a unique appearance to the guitar line.

Very few changes have been made to the basic guitar to accommodate the artist using the guitar. In particular, other than design changes to the side or rim contour, the basic design of the body has not changed and still includes a flat rim, i.e., a rim which extends around the edge of the guitar in a single plane, and front and rear faces that are symmetric relative to the rim. FIG. 1A depicts the body of the Fender® Stratocaster® guitar. (Fender® and Stratocaster® are registered trademarks of the Fender Musical Instruments Corporation, Scottsdale, Ariz.) The front and rear faces 1F, 1R of the guitar are substantially parallel to one another and lie in the same plane as the rim 2. FIG. 1B depicts the body of a Gibson® ES-335 guitar. (Gibson® is a registered trademark of the Gibson Guitar Corp., Nashville, Tenn.) As shown the rim edges 3 are parallel to one another and extend along a single plane. The front and rear faces 4F, 4R have slight curves that are substantially symmetrical about the rim 3. Most guitars fall into one of these categories of body design.

Also shown in FIGS. 1A and 1B is a schematic representation of the torso of a user of the guitar. As shown in the schematic, the rear face of the guitar body is positioned next to the player (simplistically depicted as lying against the front of the player's torso). The rims R of the guitar tend to extend along a flat plane lies at a right angle to a plane running from the player through the main playing zone of the guitar (generally in the proximity of the pickups) as shown. As a result, the heel H of the guitar body tends to stick out past the player's body. As a consequence, the player's arm needs to extend over the edge of the guitar body. During long periods of use, the player's arm begins to fatigue.

A need, therefore, exists for a more ergonomic guitar body design to help reduce player fatigue.

SUMMARY OF THE INVENTION

The present invention relates to an ergonomic guitar with a curved body portion designed to wrap slightly about the torso of the user. The guitar includes a contoured guitar body, a neck attached to the body, and a headstock on the distal end of the neck. A plurality of strings extending from the headstock to the body, a portion of the strings lying on a playing plane over the body. The contoured guitar body includes a front face located on a front or playing side of the body with a front edge extending around the periphery of the front face, and a rear face located on the back of the body and having a rear edge extending around the periphery of the rear face. At least a portion of the rear edge having a concave curvature relative to the playing plane such that the curved portion of the rear edge curves away from the playing plane.

In one embodiment, at least a portion of the front edge has a concave curvature relative to the playing plane such that the front edge and the rear edge curve in the same direction. Preferably, the curvature of the front edge is approximately the same as the curvature of the rear edge.

The front face preferably includes a front center section located approximately in the central portion of the front face, and a front transition section connecting the front center section with the front edge. A portion of the front transition section includes a first transition section curving from the front center section toward a center axis of the body, and a second transition section curving away from center axis to the front edge.

The rear face preferably includes a rear center section located approximately in the central portion of the rear face, and a rear transition section connecting the rear center section with the rear edge. A portion of the rear transition section includes a first transition section curving from the rear center section toward a center axis of the body, and a second transition section curving away from center axis to the rear edge.

In one embodiment, a substantial portion of the rear edge has a radius of curvature of between approximately 500 mm and approximately 2000 mm. Preferably the radius of curvature is approximately 1500 mm.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE EMBODIMENTS

Figure 1A:
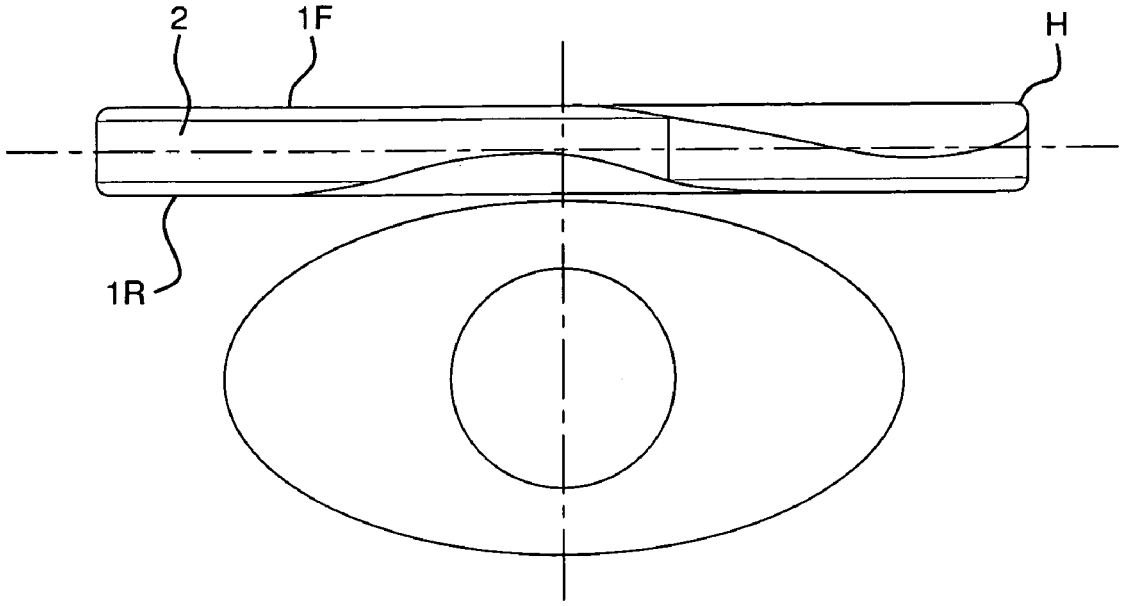
FIG. 1A Prior Art
FIGS. 1A and 1B depict the body design to two conventional guitars.
Figure 1B:
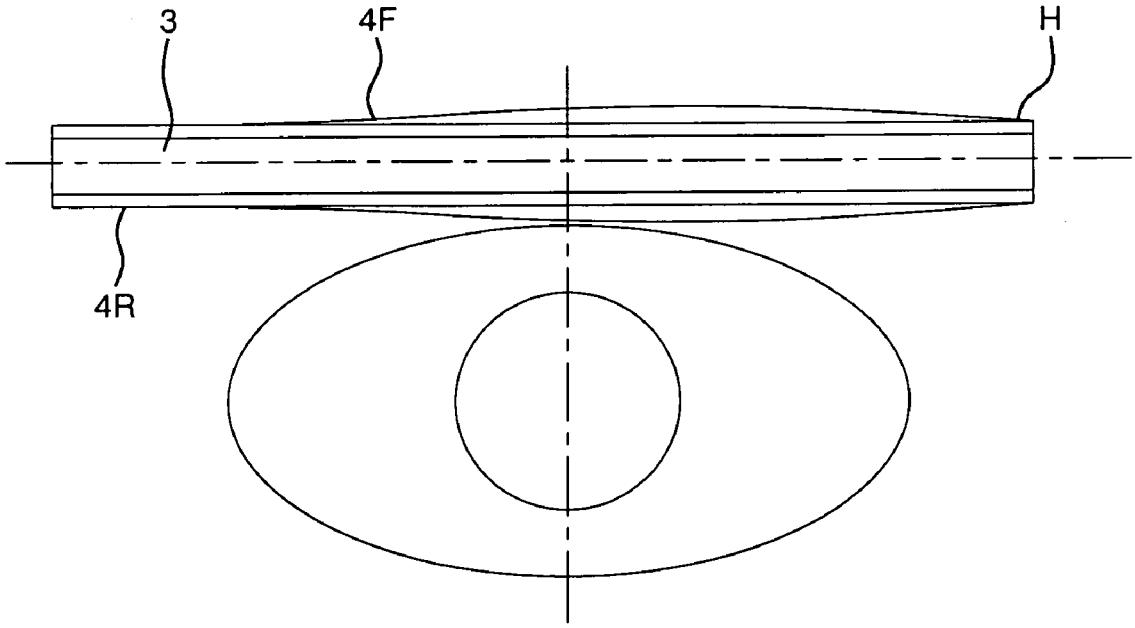
FIG. 1B Prior Art
Figure 2:
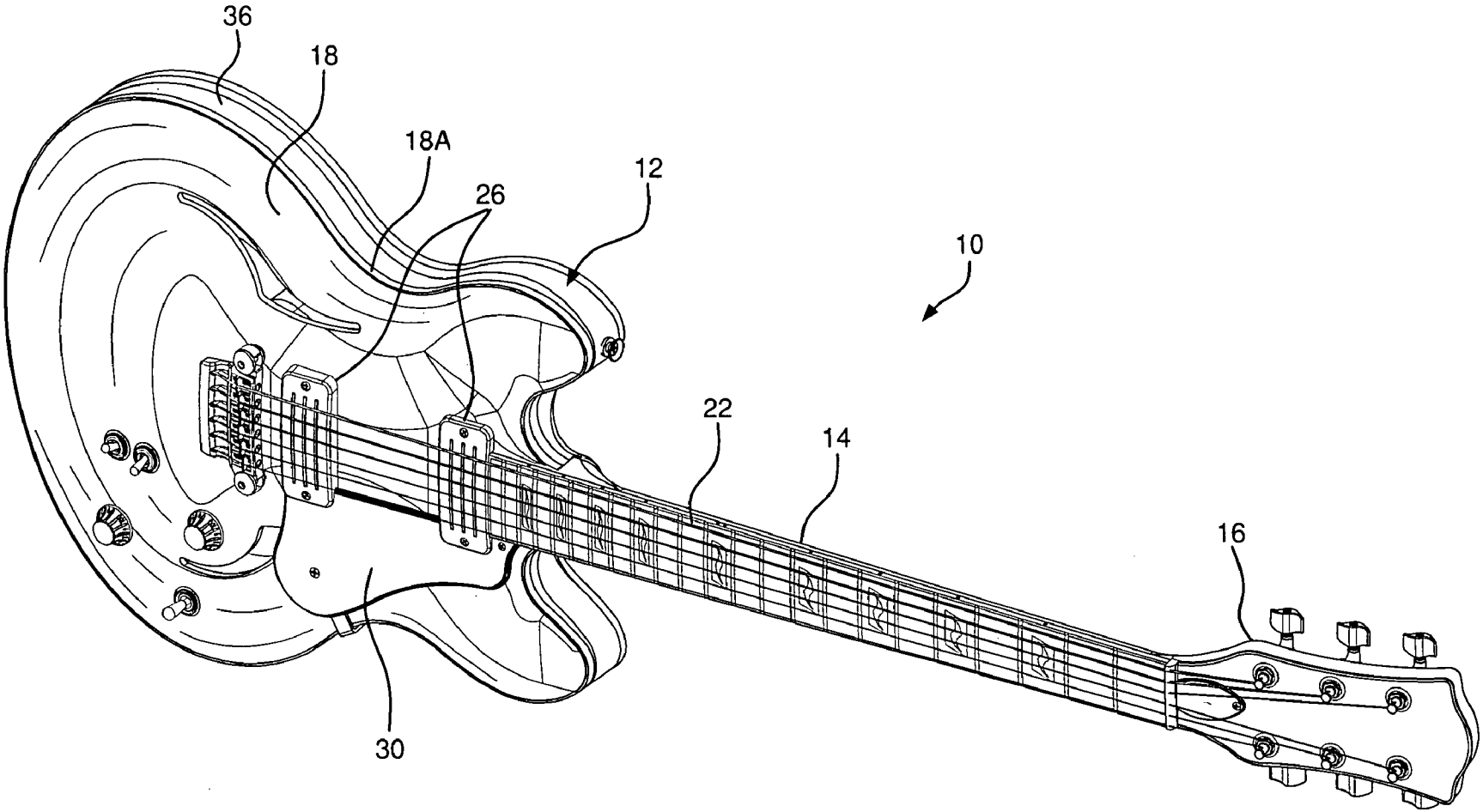
FIG. 2 is an isometric view of the ergonomic guitar according to the present invention.
Figure 3:
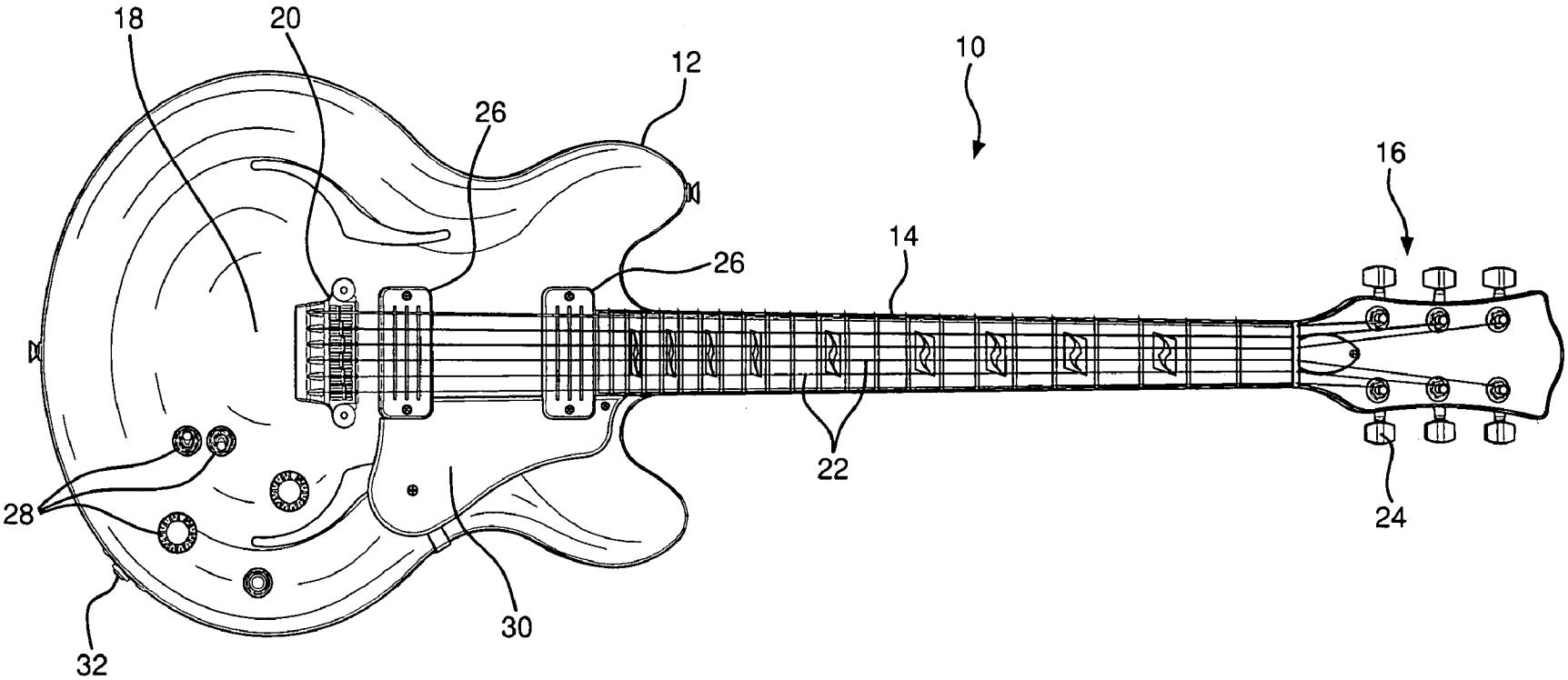
FIG. 3 is a plan view of the front of the ergonomic guitar of FIG. 2.

Referring now to FIGS. 3-10, an embodiment of an ergonomic guitar 10 is shown that is presently preferred. The guitar 10 is constructed with many conventional features, including a body 12, a neck 14 and a headstock 16. Mounted on a front face 18 of the body is a bridge 20 for securing one end of a plurality of strings 22, typically 4, 6 or 12 in number. The opposite ends of the strings are secured to the headstock through conventional machine heads 24.

One or more electrical pickups 26 are also mounted on a front face 18 of the body 12 between the bridge 18 and the location where the neck 14 extends away from the body. Conventional controls 28, such as volume and tone controls, are mounted on the body, typically on a front face 28 of the body. The guitar may also include a scratch plate or pickguard 30 mounted near the pickups. An output socket 32 is mounted on the guitar and permits a cable to be removeably connected to the guitar for transmitting audio to a guitar amplifier or other audio device.

Figure 4:
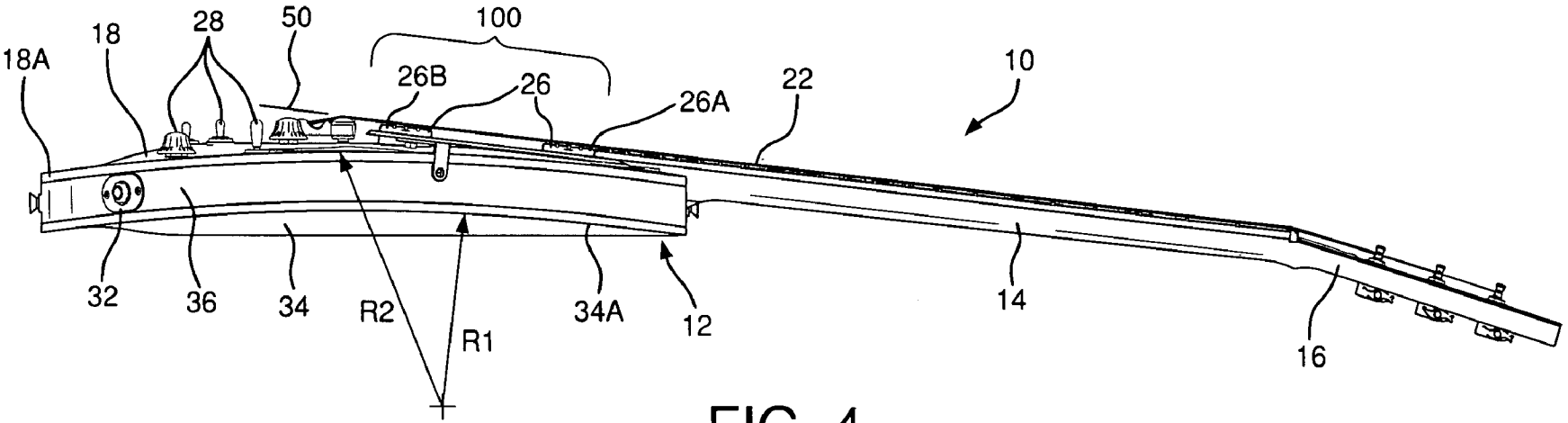
FIG. 4 is a bottom view of the guitar of FIG. 3.
Figure 5:
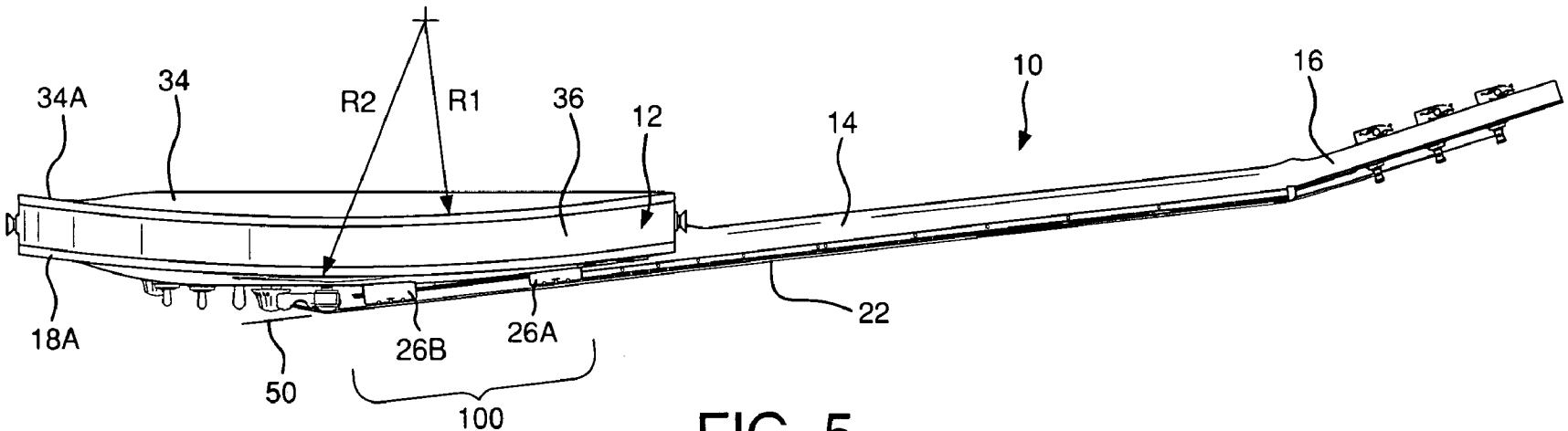
FIG. 5 is a top view of the guitar of FIG. 3.

Referring now to FIGS. 4 and 5, top and bottom views of the guitar are shown. In addition to the front face 18, the body includes a rear face 34 located on the back of the body 12. A rim 36 or side wall connects the peripheral edge 18A of the front face 18 with the peripheral edge 34A of the rear face. The rim extends around the body 12. As will be discussed in more detail below, at least the rear face 34 and rear edge 34A have a non-planar and non-linear contour so as to provide a more ergonomically shaped guitar back. In one embodiment, the rim 36 is formed integrally with either of both of the rear face 34 and front face 18. Alternately, the rim 36 may be a separate component that is attached to the front and rear faces through any conventional attachment means, such as adhesive, separate brackets, etc.

Figure 6:
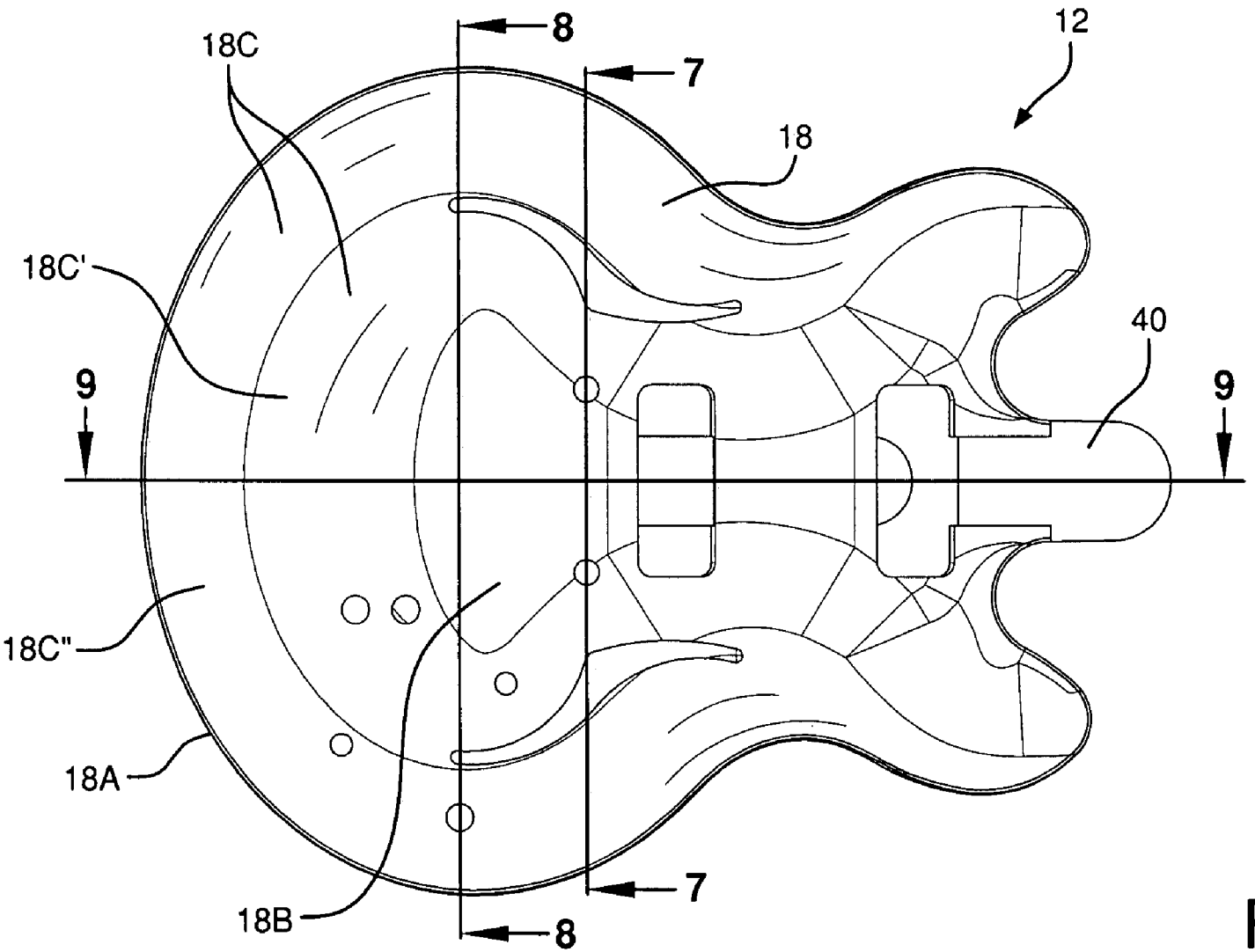
FIG. 6 is a front plan view of the body section of the guitar of FIG. 3.
Figure 7:
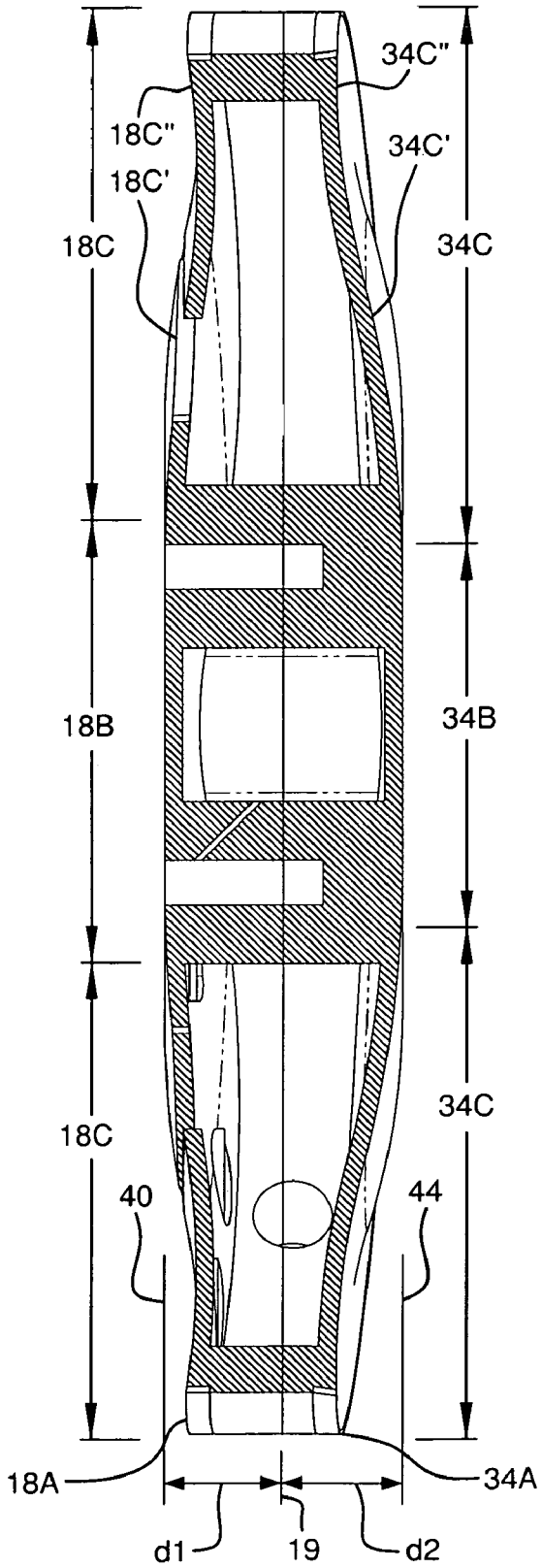
FIG. 7 is a cross-sectional view of the guitar of FIG. 6 taken along lines 7-7.
Figure 8:
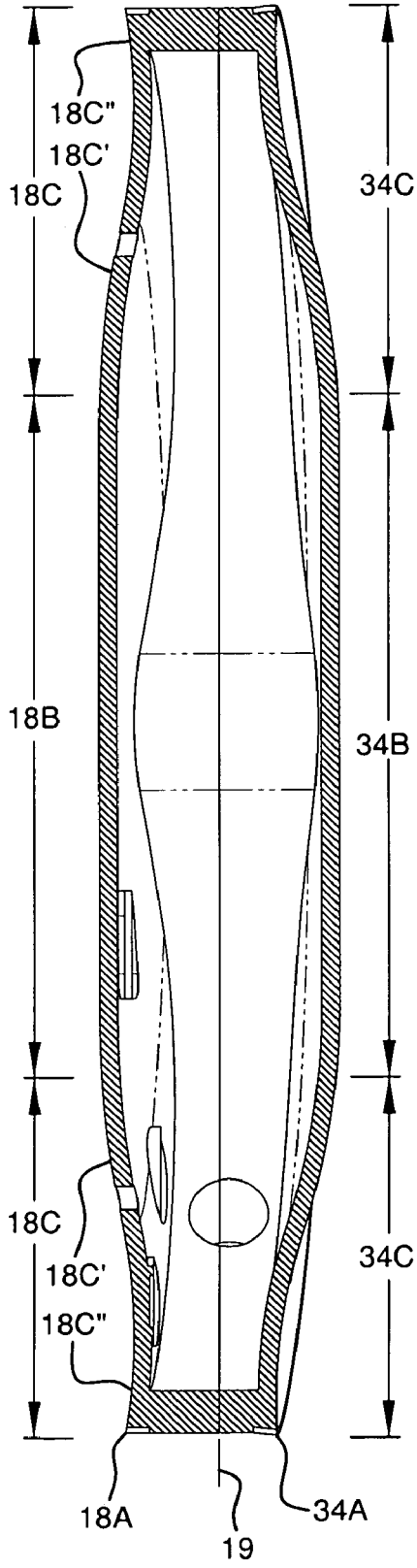
FIG. 8 is a cross-sectional view of the guitar of FIG. 6 taken along lines 8-8.
Figure 9:
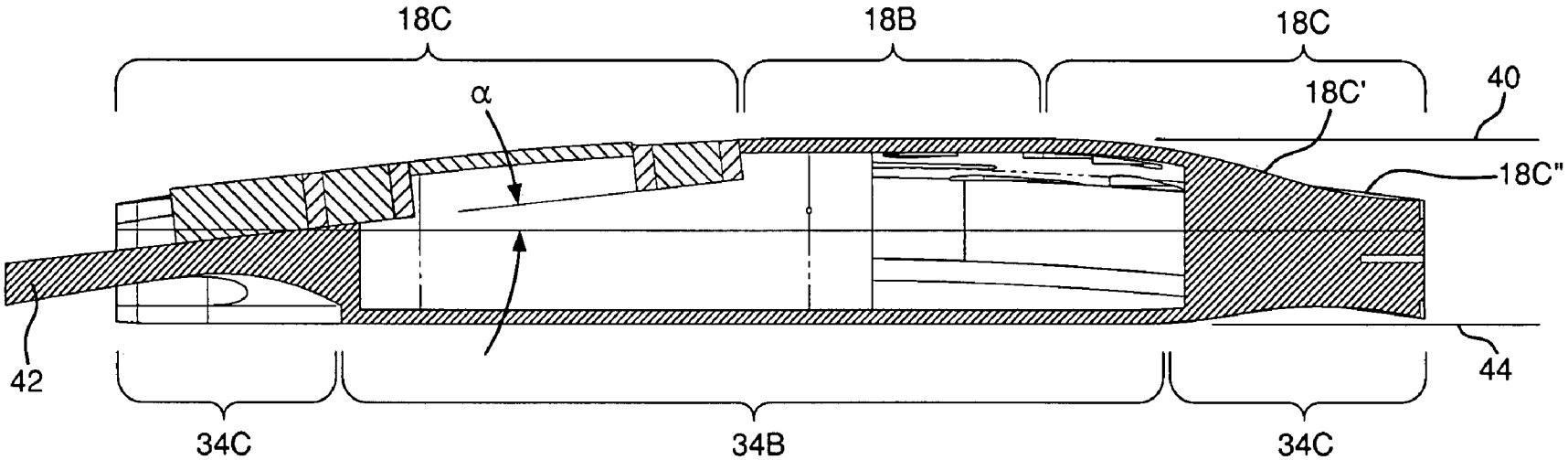
FIG. 9 is a cross-sectional view of the guitar of FIG. 6 taken along lines 9-9.
Figure 10:
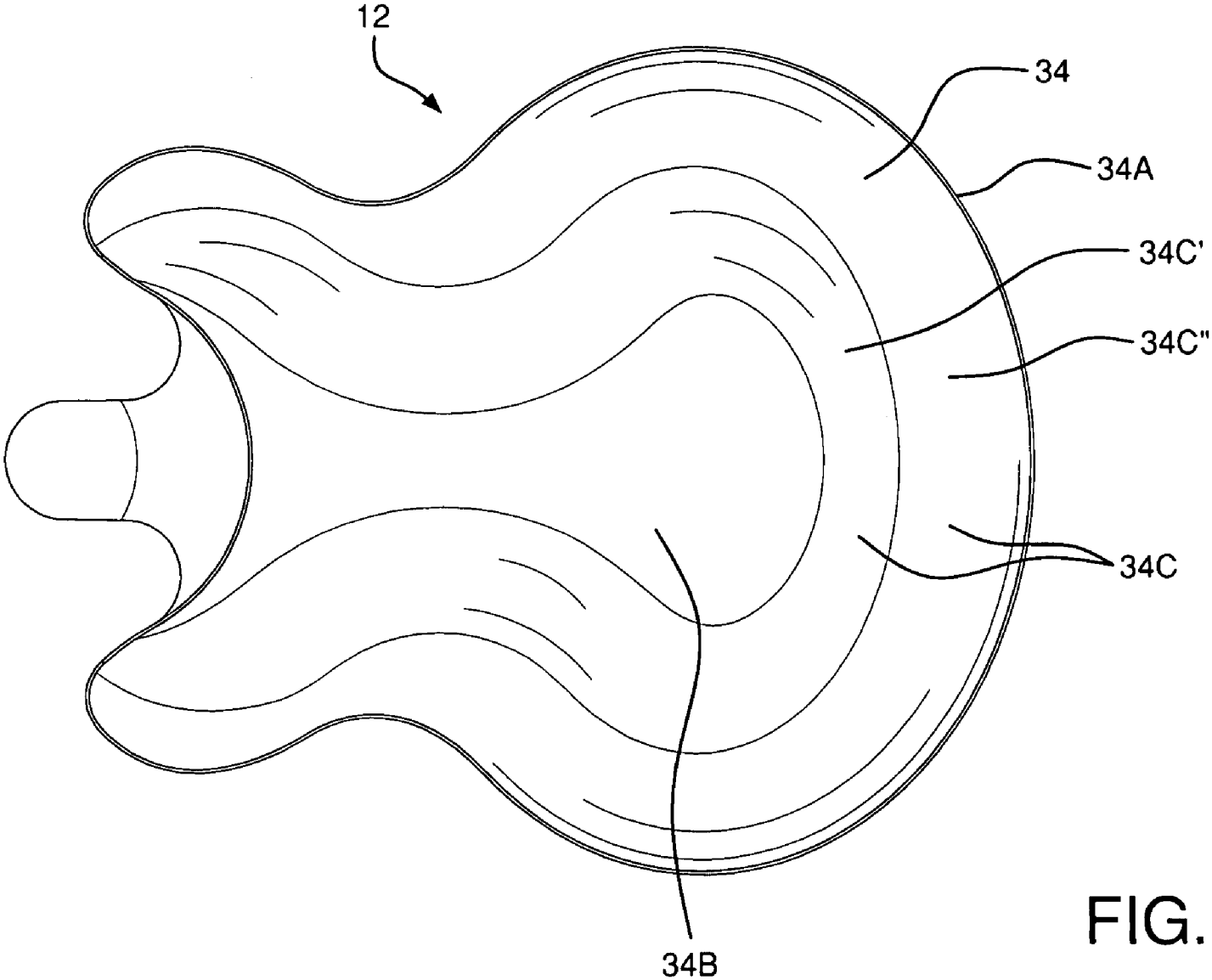
FIG. 10 is a rear plan view of the body section of the guitar of FIG. 3.

Turning to FIG. 6, the body 12 of the guitar 10 is shown with the bridge, controls, pickups and strings removed to better illustrate the details of the invention. The front face 18 preferably includes a contour that extends out from the page. With reference to FIGS. 7, 8 and 9, cross-sections of the guitar are shown in more detail. The front face 18 of the guitar includes various sections that have differing contours. A front center section 18B is located approximately in the central portion of the front face 18. Preferably the front center section 18B is substantially flat and lies along a front plane 40. However, it is also contemplated that the front center section may have some curvature. The front plane 40 is preferably located at a spaced distance d1 of about 30 mm from the centerline 19 of the body.

The front face 18 includes a front transition section 18C that connects the front center section 18B to the front edge 18A. The front transition section 18C is angled or curved from the front center section 18B to the front edge 18A. It should be apparent that since, in the preferred embodiment, the entire front edge 18A is not located on a flat plane, the front transition section will vary in contour about the front face as it slopes from the front center section 18B to the edge. As shown in FIGS. 6-9, the front transition section 18C preferably varies in curvature between the front center section and the front edge 18A. In one preferred embodiment, a portion of the front transition section includes a first transition section 34C' curving from the front center section 18B toward the center axis 19 of the body (i.e., a convex curvature), and a second transition section 18C" curving away from center axis 19 to the front edge 18A (i.e., a concave curvature). Preferably the second transition section 18C" has a concave curvature with a radius of approximately 150 mm.

Referring to FIG. 9, the neck 14 of the guitar attaches to the body 12 through a sloped neck support 42, preferably formed integrally into the body. The support 40 forms an angle a of between about 5 degrees and about 7 degrees with respect to the axis 19 of the body. In light of the curvature of the front face 18 and the angled attachment of the neck 14 in the illustrated embodiment, the pickups 26 will have different heights in order to maintain the strings on a proper plane for playing. In the illustrated embodiment of FIG. 5, the first pickup 26A has a height dimension that is less than the height dimension of the second pickup 26B to accommodate the change in contour.

The rear face 34 also includes multiple sections which can be seen in FIGS. 7-10. More particularly, the rear face includes a rear center section 34B preferably located substantially in the central portion of the rear face 34. Preferably the rear center section 34B is substantially flat and lies along a rear plane 44. However, it is also contemplated that the rear center section 34B may have some curvature. The rear plane 40 is preferably located at a spaced distance d2 of about 30 mm from the centerline 19 of the body.

The rear face 34 includes a rear transition section 34C that connects the rear center section 34B to the rear edge 34A. The rear transition section 34C is angled or curved from the rear center section 34B to the front edge 34A. It should be apparent that since the rear edge 34A is not located on a flat plane, the rear transition section will vary in contour about the rear face as it slopes from the rear center section 34B to the rear edge. As shown in FIGS. 7-10, the rear transition section 34C preferably varies in curvature. In one preferred embodiment, a portion of the rear transition section includes a first rear transition section 34C' curving from the rear center section 34B toward the center axis 19 of the body (i.e., a convex curvature), and a second rear transition section 34C" curving away from center axis 19 to the rear edge 34A (i.e., a concave curvature). Preferably the second transition section 34C" has a concave curvature with a radius of approximately 150 mm.

Figure 11:
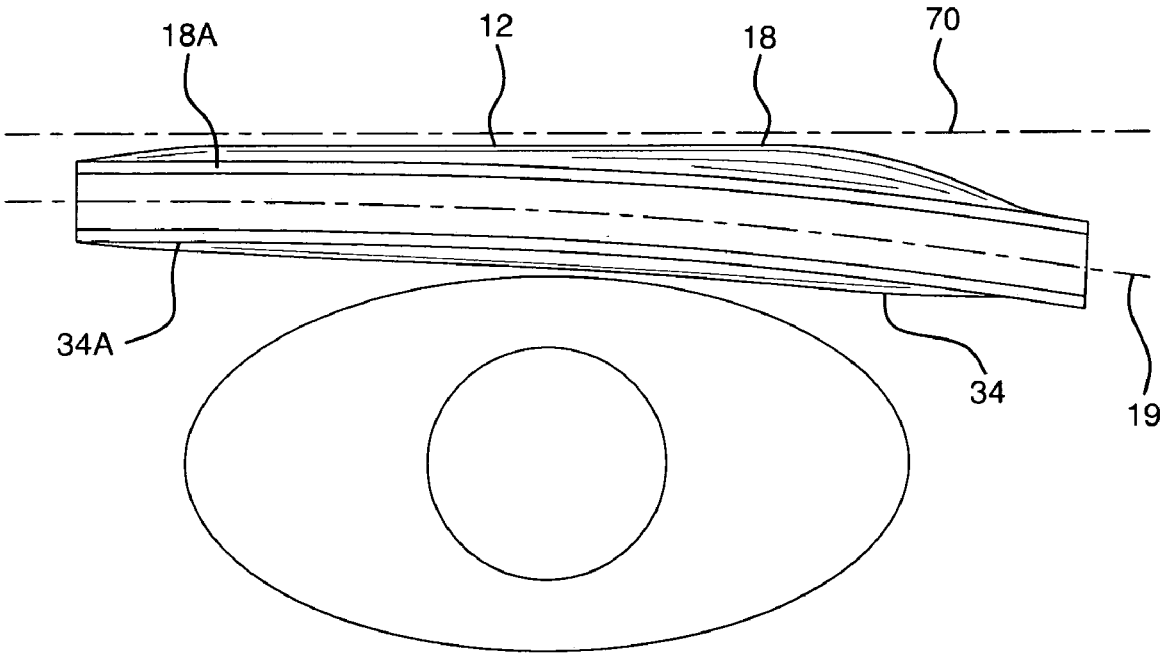
FIG. 11 depicts the body design of the guitar of FIG. 3 with a schematic representation of a user's torso adjacent to the guitar during use.

Referring back to FIGS. 4 and 5, as discussed above, the strings 22 lie substantially on a playing plane 50 in the main playing zone 100, i.e., the area over the pickups 26. The ergonomic feature of the guitar body 12 is provided by at least a portion of the rear edge 34A having a curvature R1 relative to the playing plane 50. As shown, the curvature is preferably concave with respect to the playing plane 50. The curvature is also concave with respect to a neck plane extending substantially along the face of the neck 14. This results in the rear edge 34A curving toward the torso of the player as shown in FIG. 11. While in the illustrated embodiment, most of the rear edge 34A has a substantially constant curvature R1, it is also contemplated that the curvature may only extend over a portion of the rear edge, such as in the sections close to the player's body. The remaining sections can have differing curvatures or non-curved (i.e., straight) edges. In one preferred embodiment, the radius of curvature R1 is approximately 1500 mm.

In the illustrated embodiment, at least a portion of the front edge 18A also has a curvature R2 relative to the playing plane 50. As shown, the curvature is preferably concave in shape with respect to the playing plane 50 and, thus, curves in the same direction as the curvature of the rear edge 34A. This results in the front edge 18A also curving toward the torso of the player as shown in FIG. 11. Thus, preferably a substantial portion of both the front and rear edges curve in the same direction. While in the illustrated embodiment, most of the front edge 18A has a substantially constant curvature R2, it is also contemplated that the curvature may only extend over a portion of the front edge, such as in the sections close to the player's body. The remaining sections can have differing curvatures or non-curved (i.e., straight) edges. Also, the curvatures R1 and R2 of the rear and front edges need not be the same. Furthermore, it is also contemplated that the front edge 18A may not curve at all, instead lying substantially on a plane that may be the same as or different from the playing plane 50. In the illustrated embodiment, the front edge has a curvature with a radius of approximately 1540 mm, which is the same radius as the rear edge 34A plus the approximate thickness of the guitar body at the rim.

It is contemplated that the rear edge 34A and optionally the front edge 18A would have a curvature ranging from about 500 mm radius to about 2000 mm radius.

As shown in FIG. 11, the curvature of the rear edge 18A and the overall shape of the body 12 provide a three dimensional, contoured guitar 10 that tends to wrap around the torso of the player, providing perfect balance and ease of playability. As shown, the present invention results in the center axis 19 of the guitar body 12 having a curvature relative to the prior art designs which are depicted by the line marked with the numeral 70.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

The invention claimed is:

1. An ergonomic guitar comprising:

a contoured guitar body;

a neck attached to the body; and a headstock on the distal end of the neck; and a plurality of strings extending from the headstock to the body, a portion of the strings lying on a playing plane over the body;

the contoured guitar body having a top, a bottom, and two sides, the neck attached to the body on one side such that the top is located above where the neck attaches and the bottom is located below where the neck attaches, the body including:

a front face located on a front or playing side of the body with a front edge extending around the periphery of the front face, a substantial portion of the front edge that extends along the top of the body being curved relative to the playing plane such that the curved top front edge portion curves away from the playing plane, and a substantial portion of the front edge that extends along the bottom of the body being curved relative to the playing plane such that the curved bottom front edge portion curves away from the playing plane in substantially the same direction as the portion along the top, the front face having a front center section located approximately in the central portion of the front face, the front center section protruding outward from a plane defined by the front edges, and a front transition section connecting the front center section with the front edge, and wherein a portion of the front transition section curves from the front center section toward a center axis of the body;

a rear face located on the back of the body and having a rear edge extending around the periphery of the rear face, a substantial portion of the rear edge that extends along the top of the body being curved relative to the playing plane such that the curved top rear edge portion curves away from the playing plane, and a substantial portion of the rear edge that extends along the bottom of the body being curved relative to the playing plane such that the curved bottom rear edge portion curves away from the playing plane in substantially the same direction as the portion along the top, and the rear face having a rear center section located approximately in the central portion of the rear face, the rear center section protruding outward from a plane defined by the rear edges, and a rear transition section connecting the rear center section with the rear edge, and wherein a portion of the rear transition section curves from the rear center section toward the center axis of the body.

2. An ergonomic guitar according to claim 1 wherein the curved top and bottom front edge portions a concave curvature relative to the playing plane such that the front edge and the rear edge curve in the same direction.

3. An ergonomic guitar according to claim 2 wherein the curvature of the top and bottom front edge portions is approximately the same as the curvature of the top and bottom rear edge portions.

4. An ergonomic guitar according to claim 1 wherein the front transition section includes a first transition section curving from the front center section toward a center axis of the body, and a second transition section curving away from center axis to the front edge.

5. An ergonomic guitar according to claim 1 wherein the rear transition section includes a first transition section curving from the rear center section toward a center axis of the body, and a second transition section curving away from center axis to the rear edge.

6. An ergonomic guitar according to claim 1 wherein a substantial portion of the front face curves in three dimensions away from the playing plane toward the top, side and bottom of the body, and wherein a substantial portion of the rear face curves in three dimensions toward the top, side and bottom of the body.

7. An ergonomic guitar including a contoured guitar body, a neck attached to the body, and a headstock on the distal end of the neck, a plurality of strings extend from the headstock to the body, a portion of the strings lying on a playing plane over the body, the contoured body comprising:

a front face located on a front or playing side of the guitar body and having a front edge extending around the periphery of the front face, the front face having a front center section located approximately in the central portion of the front face and spaced a distance from a central axis of the body that is more than the distance that the front edge is spaced from the central axis of the body such that the front center section protrudes from a plane defined by the front edge, and a front transition section connecting the front center section with the front edge, the front transition section curving from the front center section to the front edge;

a rear face located on the back of the body and having a rear edge extending around the periphery of the rear face, the rear face having a rear center section located approximately in the central portion of the rear face and spaced apart from the central axis of the body that is more than the distance that the rear edge is spaced from the central axis of the body such that the rear center section protrudes from a plane defined by the rear edge, and a rear transition section connecting the rear center section with the rear edge, the rear transition section curving from the rear center section to the rear edge; and a rim connecting the front edge and the rear edge;

at least a portion of the rear edge has a concave curvature relative to the playing plane which causes the concave curvature portion of the rear edge to curve away from the playing plane, and at least a portion of the front edge has a concave curvature relative to the playing plane which causes the concave curvature portion of the front edge to curve away from the playing plane in substantially the same direction as the concave curvature portion of the rear edge.

8. An ergonomic guitar according to claim 7 wherein the rim is an integral portion of either or both the front face and the rear face.

9. An ergonomic guitar according to claim 7 wherein a substantial portion of the rear edge has a radius of curvature of between approximately 500 mm and approximately 2000 mm.

10. An ergonomic guitar according to claim 9 wherein the radius of curvature is approximately 1500 mm.

11. An ergonomic guitar according to claim 9 wherein the radius of curvature of the front edge is approximately the same as the radius of curvature of the rear edge plus the approximate thickness of the rim.

12. An ergonomic guitar according to claim 7 wherein the front transition section includes a portion with a concave curvature relative to a center axis of the body.

13. An ergonomic guitar according to claim 7 wherein a portion of the front transition section includes a first transition section curving from the front center section toward a center axis of the body, and a second transition section curving away from center axis to the front edge.

14. An ergonomic guitar according to claim 7 wherein the rear transition section includes a portion with a concave curvature relative to a center axis of the body.

15. An ergonomic guitar according to claim 7 wherein a portion of the rear transition section includes a first transition section curving from the rear center section toward a center axis of the body, and a second transition section curving away from center axis to the rear edge.

16. An ergonomic guitar according to claim 7 wherein a substantial portion of the front face curves in three dimensions away from the playing plane toward the top, side and bottom of the body, and wherein a substantial portion of the rear face curves in three dimensions toward the top, side and bottom of the body.

17. An ergonomic guitar comprising:

a contoured guitar body;

a neck attached to the body; and a headstock on the distal end of the neck; and a plurality of strings extending from the headstock to the body, a portion of the strings lying on a playing plane over the body;

the contoured guitar body having a top, a bottom, and two sides, the neck attached to the body on one side such that the top is located above where the neck attaches and the bottom is located below where the neck attaches, the body including:

a front face located on a front or playing side of the body with a front edge extending around the periphery of the front face, the front face having a front center section that protrudes outward from a plane defined by the front edge, and a front transition section extending from the front center section to the front edge, the front transition section curving from the front center section to the front edge, and at least portions of the front center section, front transition section and front edge are curved relative to the playing plane such that the curved portions of the front center section, front transition section and front edge curve away from the playing plane, p2 a rear face located on the back of the body and having a rear edge extending around the periphery of the rear face, the rear face having a rear center section, and a rear transition section extending and curving away from the rear center section to the rear edge, and at least portions of the rear center section, rear transition section and rear edge are curved relative to the playing plane such that the curved portions of the rear center section, rear transition section and rear edge curve away from the playing plane, and a rim connecting the front edge and the rear edge, wherein the curved portions of the rear edge and front edge that curve away from the playing plane curve in the same direction.

18. An ergonomic guitar according to claim 17 wherein a portion of the rim is formed integral with the front face and a portion of the rim is formed integral with the rear face.

19. An ergonomic guitar according to claim 17 wherein a portion of the front transition section includes a first transition section curving from the front center section toward a center axis of the body, and a second transition section curving away from center axis to the front edge; and wherein a portion of the rear transition section includes a first transition section curving from the rear center section toward a center axis of the body, and a second transition section curving away from center axis to the rear edge.

20. An ergonomic guitar according to claim 17 wherein a substantial portion of the front face curves in three dimensions away from the playing plane toward the top, side and bottom of the body, and wherein a substantial portion of the rear face curves in three dimensions toward the top, side and bottom of the body.

* * * * *